US012038246B1

(12) United States Patent
Withey

(10) Patent No.: US 12,038,246 B1
(45) Date of Patent: Jul. 16, 2024

(54) DROP SAFETY TRIGGER ASSEMBLY

(71) Applicant: Kimber IP, LLC, Troy, AL (US)

(72) Inventor: Michael Withey, Brundidge, AL (US)

(73) Assignee: Kimber IP, LLC, Troy, AL (US)

( * ) Notice: Subject to any disclaimer, the term of this patent is extended or adjusted under 35 U.S.C. 154(b) by 0 days.

(21) Appl. No.: 18/141,560

(22) Filed: May 1, 2023

(51) Int. Cl.
*F41A 19/12* (2006.01)
*F41A 17/56* (2006.01)
*F41A 19/16* (2006.01)

(52) U.S. Cl.
CPC ..... *F41A 19/12* (2013.01); *F41A 17/56* (2013.01); *F41A 19/16* (2013.01)

(58) Field of Classification Search
CPC ..... F41A 19/12; F41A 17/56; F41A 17/58; F41A 19/16; F41A 19/17; F41A 17/28
USPC ..... 42/69.01, 69.02
See application file for complete search history.

(56) References Cited

U.S. PATENT DOCUMENTS

| | | | | |
|---|---|---|---|---|
| 6,553,706 | B1 | 4/2003 | Gancarz et al. | |
| 10,809,031 | B2 * | 10/2020 | Geissele | F41A 19/43 |
| 2023/0113214 | A1 * | 4/2023 | Roessel | F41A 19/10 42/69.01 |
| 2023/0400273 | A1 * | 12/2023 | Seidl | F41A 17/42 |

FOREIGN PATENT DOCUMENTS

| | | | |
|---|---|---|---|
| WO | WO-2014084757 A1 * | 6/2014 | F41A 19/16 |

OTHER PUBLICATIONS

Tilen Matkovic, "What Is a Savage AccuTrigger?"—Opticstradeblog, Jan. 31, 2023, Publisher: Optics Trade, 1 pp. (Accutrigger introduced 2002).

* cited by examiner

*Primary Examiner* — Reginald S Tillman, Jr.
(74) *Attorney, Agent, or Firm* — Kaplan Breyer Schwarz, LLP

(57) ABSTRACT

A drop safety trigger assembly is provided having a fire control housing mounted in a receiver, a rotatable sear, a rotatable sear stop, and a sear release. When a force by a user is applied to the trigger shoe, the sear stop rotates at its pivot point against the force of the trigger spring to cause a sear stop protuberance to apply a force to an upper surface of the sear release to release a projection of the sear release from the notch of the sear to cause the sear to rotate due to the force of the firing pin spring on the second end of the sear to cause the first end of the sear to disengage from the firing pin to initiate a discharge of the rifle. When no force by a user is applied to the trigger shoe to rotate the sear stop, but when the sear projection of the sear release disengages from the notch of the sear, the sear projection of the sear stop engages the notch of the sear to prevent a discharge of the rifle.

11 Claims, 12 Drawing Sheets

DROP SAFETY TRIGGER ASSEMBLY

BACKGROUND OF THE INVENTION

The present invention is directed to firearms. More particularly, the present invention is directed to an improved drop safety trigger assembly for a firearm.

Triggers for firearms must provide for both ease of use and safety. Some triggers, such as triggers for competition reduce trigger creep by reducing the amount of sear engagement by a sear release. A light and crisp trigger pull is highly desirable in many situations to improve accuracy and performance. However, too light a trigger pull can cause safety concerns if the firearm if, for example, the firearm is dropped or banged. That is, a firearm in a ready to fire condition may "jar off" when the firearm is dropped, causing the sear to be released and the firearm to be discharged.

Some firearms address this issue by having a separate blade associated with its trigger. For example, the Savage Accutrigger uses a separate pivotable device that must be engaged along with the trigger.

There is a need for a firearm that prevents a jar off without the need for a separate feature that must be engaged by a user of the firearm.

SUMMARY OF THE INVENTION

The present invention is directed to a drop safety trigger assembly for a firearm such as a bolt action rifle. The rifle includes a receiver, a barrel, a firing pin and firing pin spring.

The drop safety trigger assembly includes a fire control housing disposed in the receiver and a sear rotatably secured to the fire control housing. The sear includes a first end to engage and disengage the firing pin, a central pivot point, and a second end having a notch. The drop safety trigger assembly further includes a sear stop rotatably secured to the fire control housing that has a first end, a central pivot point rotatably secured to the fire control housing, a second end having a sear stop projection for receipt in the notch of the sear, a sear stop protuberance disposed between the sear stop pivot point and the second end, and a trigger shoe. The drop safety trigger assembly further includes a sear release rotatably secured to the fire control housing. The sear release includes a first end, a second end having a sear release projection to receive the notch of the sear, a central pivot point coaxial with the central pivot point of the sear stop, the pivot point disposed between the first end and the second end of the sear release, and an upper surface to engage the sear stop protuberance. Finally, the drop safety trigger assembly includes a trigger spring to bias the first end of the sear release downwardly.

When a force by a user is applied to the trigger shoe, the sear stop rotates at its pivot point against the force of the trigger spring to cause the sear stop protuberance to apply a force to the upper surface of the sear release to release the sear projection of the sear release from the notch of the sear to cause the sear to rotate due to the force of the firing pin spring on the second end of the sear to cause the first end of the sear to disengage from the firing pin to initiate a discharge of the rifle. However, when no force by a user is applied to the trigger shoe to rotate the sear stop, but when the sear projection of the sear release disengages from the notch of the sear due to, for example, a jar off condition, the sear projection of the sear stop engages the notch of the sear to prevent a discharge of the rifle.

The firearm may be a bolt action rifle having a bolt slidably disposed in the receiver where the bolt has the firing pin and firing pin disposed therein.

A safety bar may be manually slidably disposed in the fire control housing between a first position and a second position, wherein safety bar prevents a discharge of the rifle from occurring when in the first position by engaging the sear stop, and wherein the safety bar allows for discharge of the rifle to occur when in the second position, wherein the safety bar disengages from the sear stop. A manually operated trigger adjuster may be provided to change the force of the trigger spring on the first end of the sear release. The trigger adjuster may be a threaded fastener. The trigger shoe may be slidably adjustable within a slot in the sear stop.

DETAILED DESCRIPTION

Figure 1:
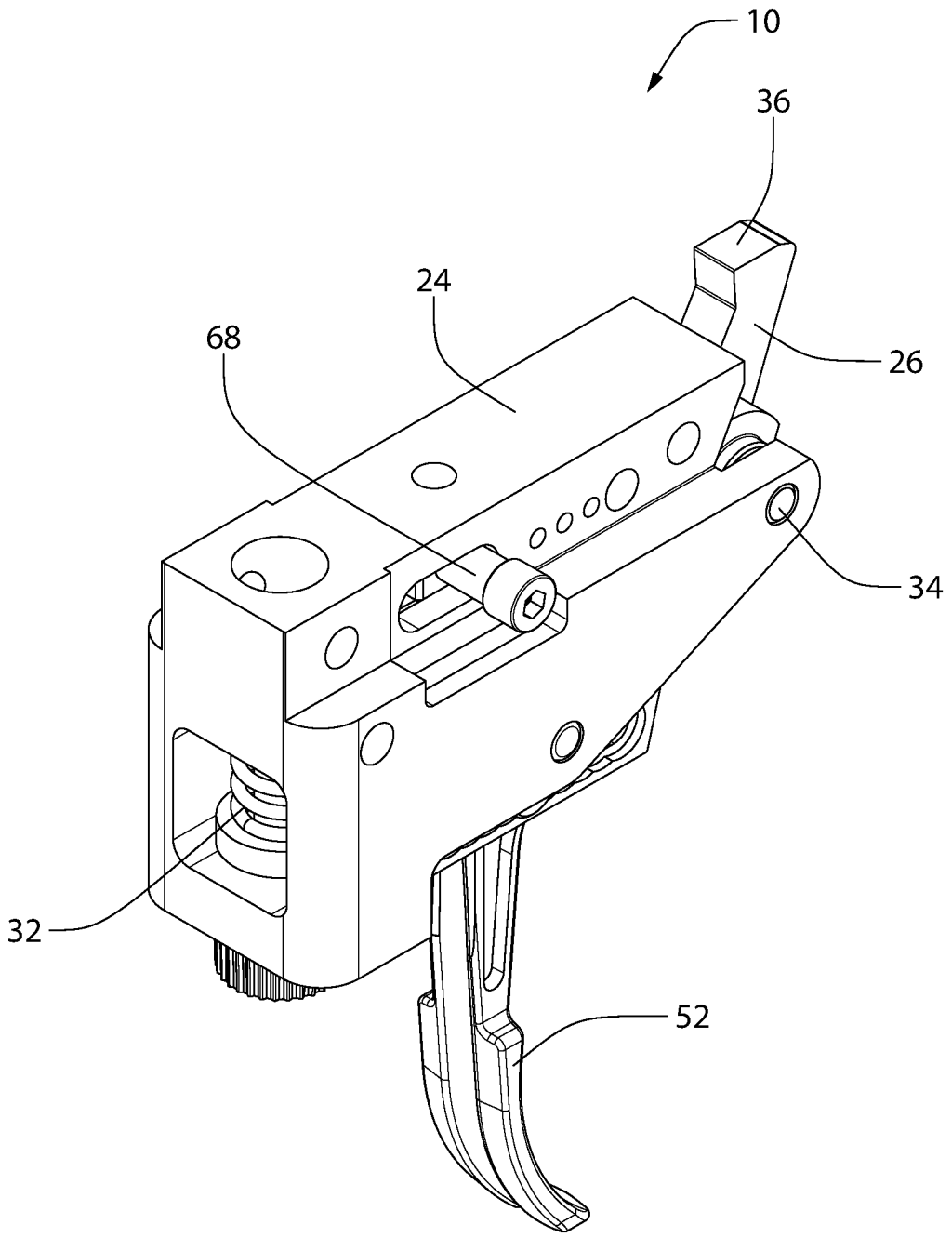
FIG. 1 rear, isometric view of a drop safety trigger assembly for a bolt action rifle in accordance with an exemplary embodiment of the present invention.
Figure 2:
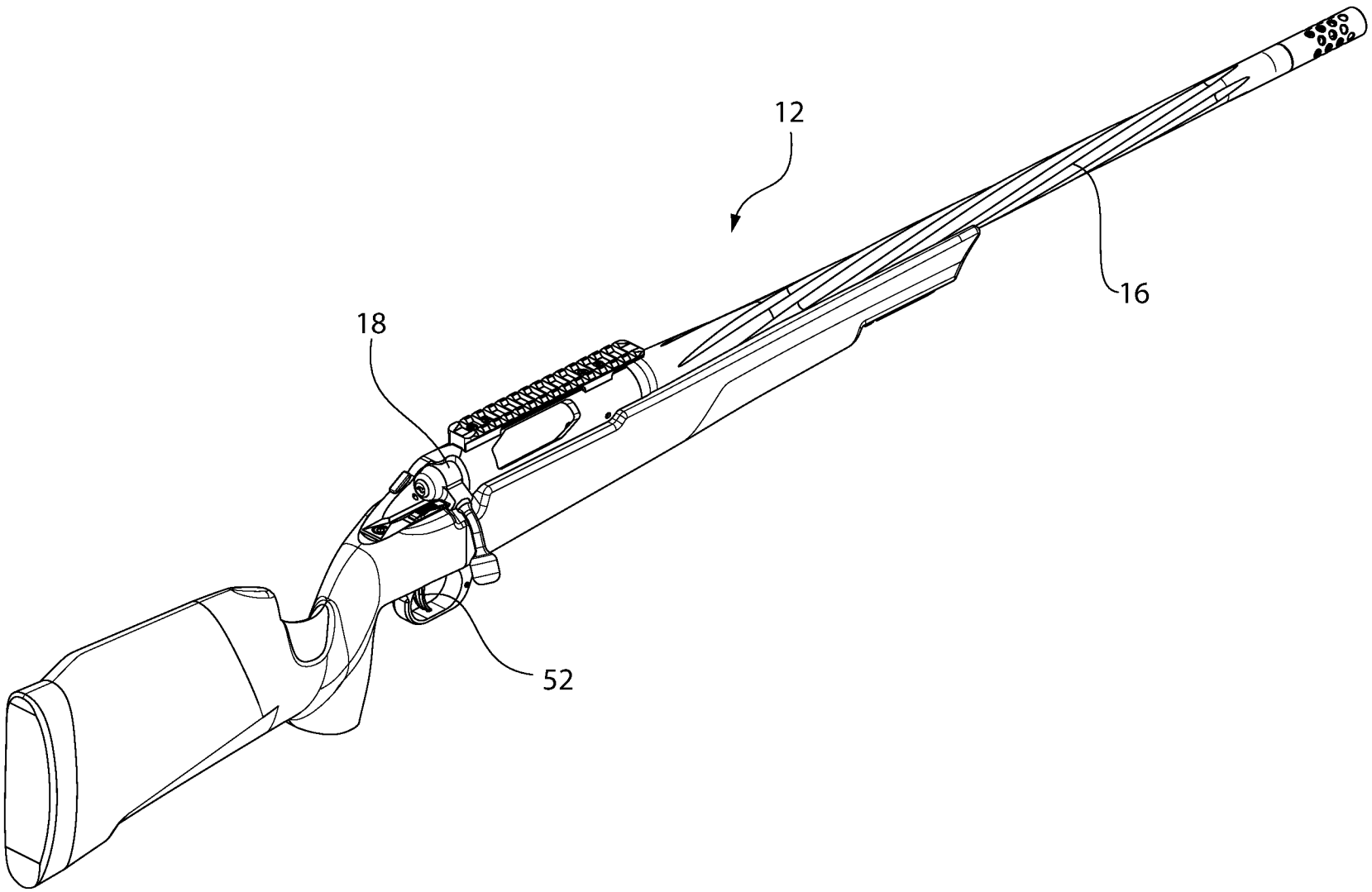
FIG. 2 is the bolt action rifle having the drop safety trigger assembly of FIG. 1.
Figure 3:
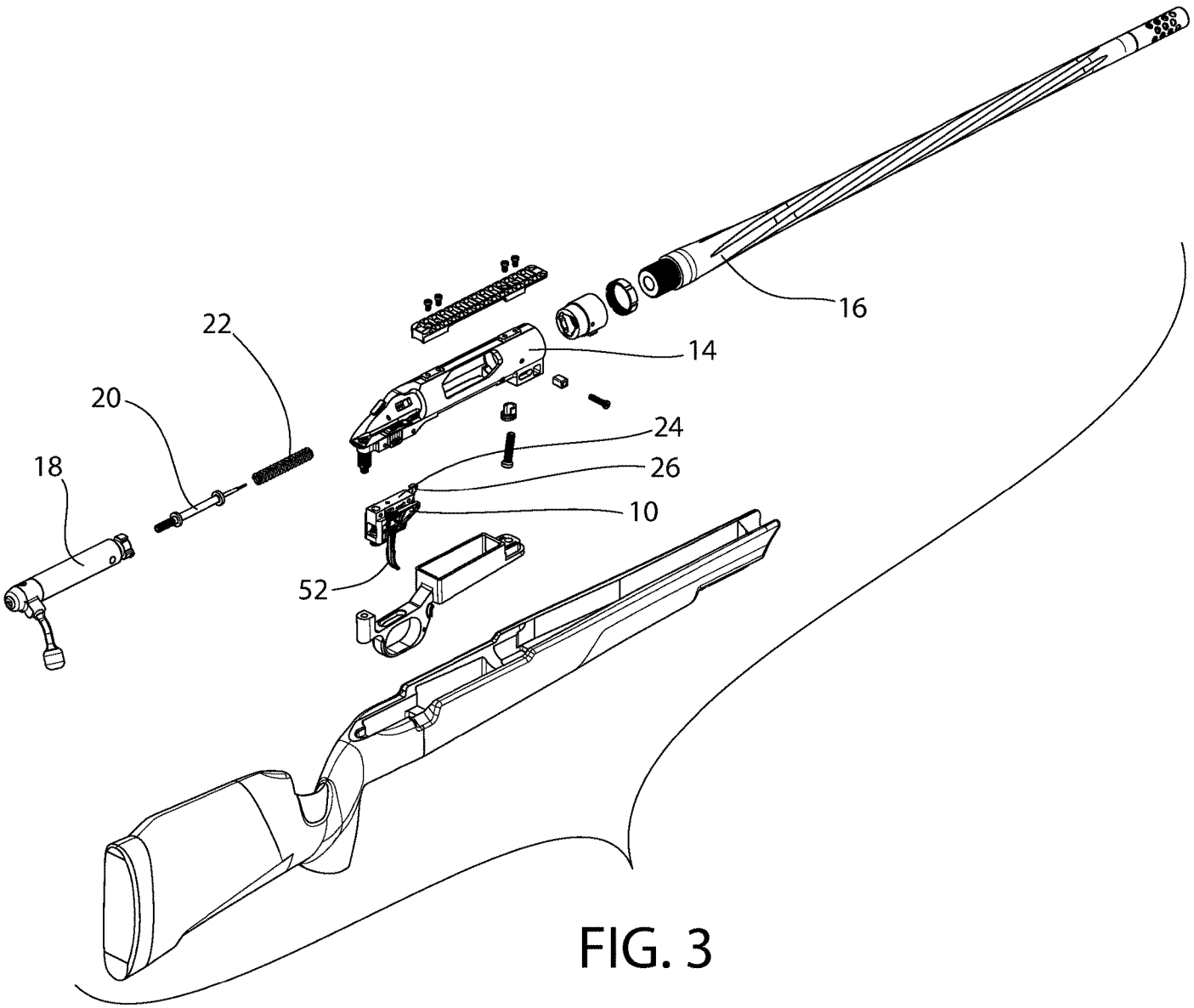
FIG. 3 is an exploded isometric view of the bolt action rifle of FIG. 2.
Figure 4:
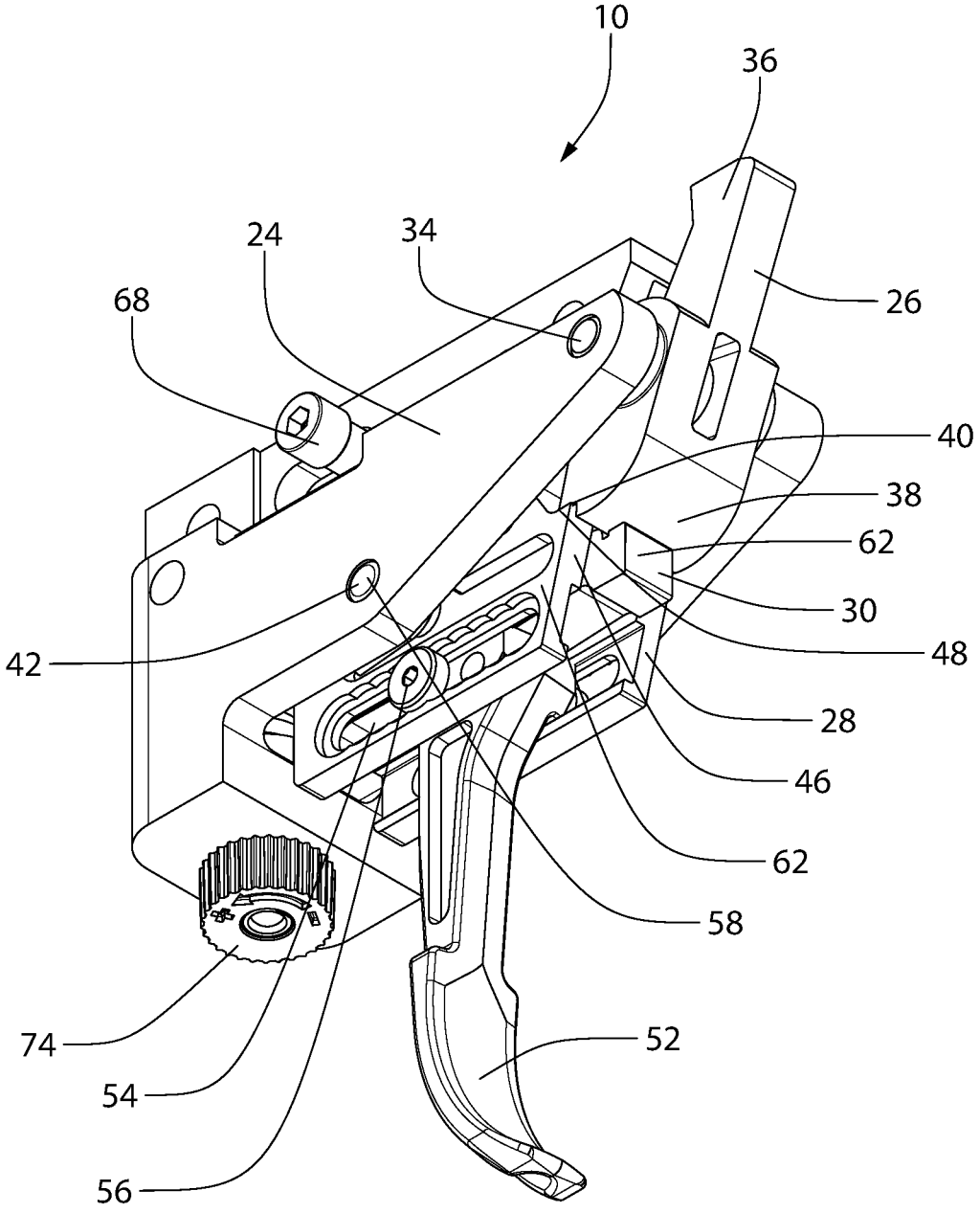
FIG. 4 is a bottom, isometric view of the drop safety trigger assembly for a bolt action rifle of FIG. 1.
Figure 5:
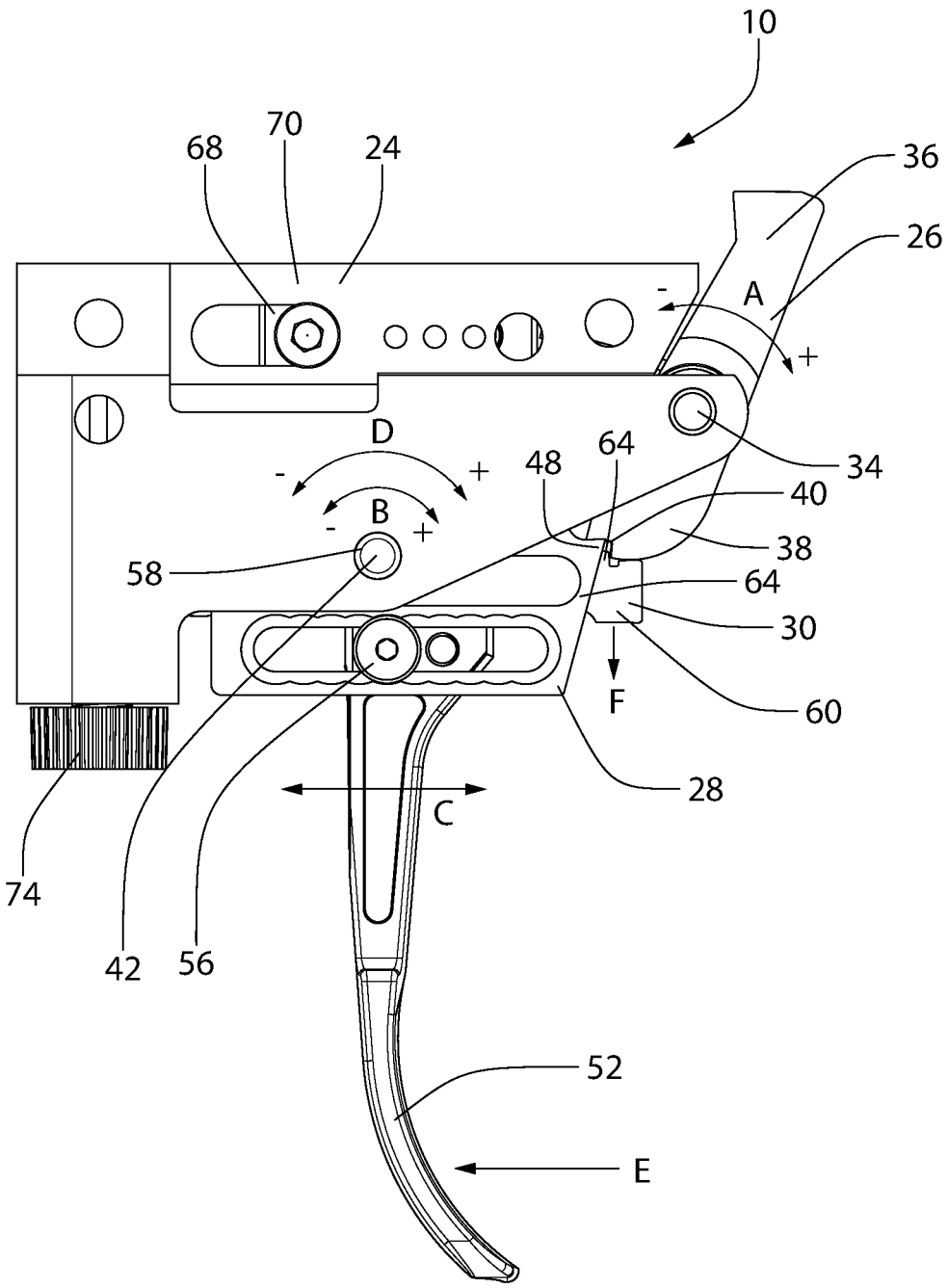
FIG. 5 is a side, elevation view of the drop safety trigger assembly for a bolt action rifle of FIG. 1.
Figure 6:
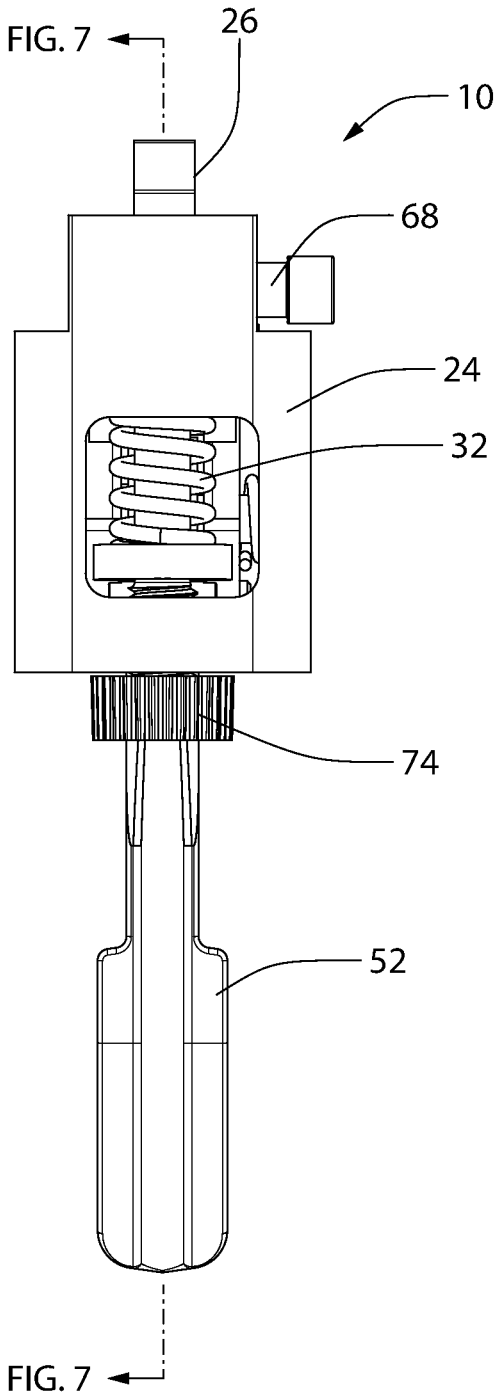
FIG. 6 is a rear, elevation view of the drop safety trigger assembly for a bolt action rifle of FIG. 1.

Referring now to the drawing figures wherein like part numbers refer to like elements throughout the several views, there is shown in FIGS. 1 and 4-11 a drop safety trigger assembly 10 for, for example, a bolt action rifle 12 (see FIGS. 2-3) in accordance with an exemplary embodiment of the present invention. It is noted that the description here is directed to a bolt action firearm; however, it is intended that the present invention be applied to any suitable firearm. The bolt action rifle 12 includes a receiver 14, a barrel 16 and a bolt 18 that is slidably and rotatably disposed in the receiver 14, as are generally known. The bolt 18 houses a firing pin 20 and firing pin spring 22, again as are typically known (see FIG. 3).

Figure 12:
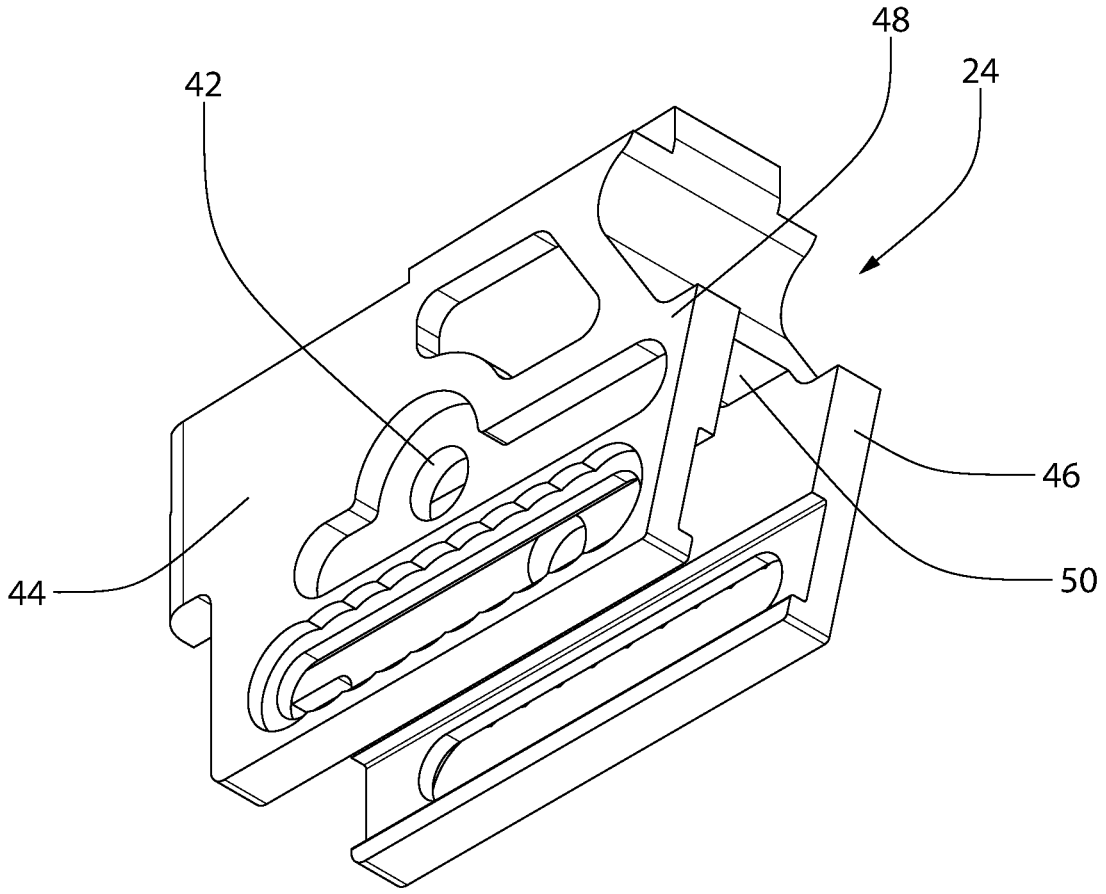
FIG. 12 is an isometric view of a fire control housing of the drop safety trigger assembly for a bolt action rifle of FIG. 1.

The drop safety trigger assembly 10 of the present invention is disposed on the receiver 14 and generally includes a fire control housing 24 (see FIG. 12), a sear 26, a sear stop 28, a sear release 30, and a trigger spring 32. The fire control housing 24 is disposed on, for example, mounted to the receiver 14 using fastening hardware, adjacent to the firing pin 20 and firing pin spring 22.

The sear 26 is secured to the fire control housing 24 and is rotatable in directions A+, A− with respect to the fire control housing 24 about a pivot point 34 that is approximately centrally located on the sear 26 (see FIGS. 5 and 7-11). The sear 26 includes a first end 36 to engage and disengage the firing pin 20, the central pivot point 34, and a second end 38 having a notch 40.

The sear stop 28 is secured to the fire control housing 24 and is rotatable in directions B+, B− with respect to the fire control housing 24 about a central pivot point 42 (see FIGS. 5 and 7-11). The sear stop 28 includes a first end 44, the central pivot point 42 and a second end 46 having a sear stop projection 48 for receipt in the notch 40 of the sear 26. The sear stop 28 further includes a sear stop protuberance 50 disposed between the sear stop pivot point 42 and the second end 46 of the sear stop 28. A trigger shoe 52 is disposed on the sear stop 28 and may be integral to it, or slidably adjustable in lateral directions C+, C− (see FIGS. 5 and 7-11) that is secured in a slot 54 in the sear stop 28 by a fastener 56, for example, a threaded fastener.

The sear release 30 is secured to the sear stop 28 and is rotatable in directions D+, D− with respect to the sear stop 28 about pivot point 58 (see FIGS. 5 and 7-11). Sear release pivot point 58 is coaxial to sear stop pivot point 42. The sear release 30 includes a first end 60, a second end 62 and the pivot point 58. The pivot point 58 is disposed approximately centrally between the first end 60 and the second end 62 of the sear release 30. The sear release 30 has a sear release projection 64 to receive the notch 40 of the sear 26. The sear release 30 has an upper surface 66 to engage the sear stop protuberance 50.

Finally, the drop safety trigger assembly 10 includes the trigger spring 34 to bias the first end 60 of the sear release 30 in a downward direction F (see FIGS. 5 and 7-11).

Figure 7:
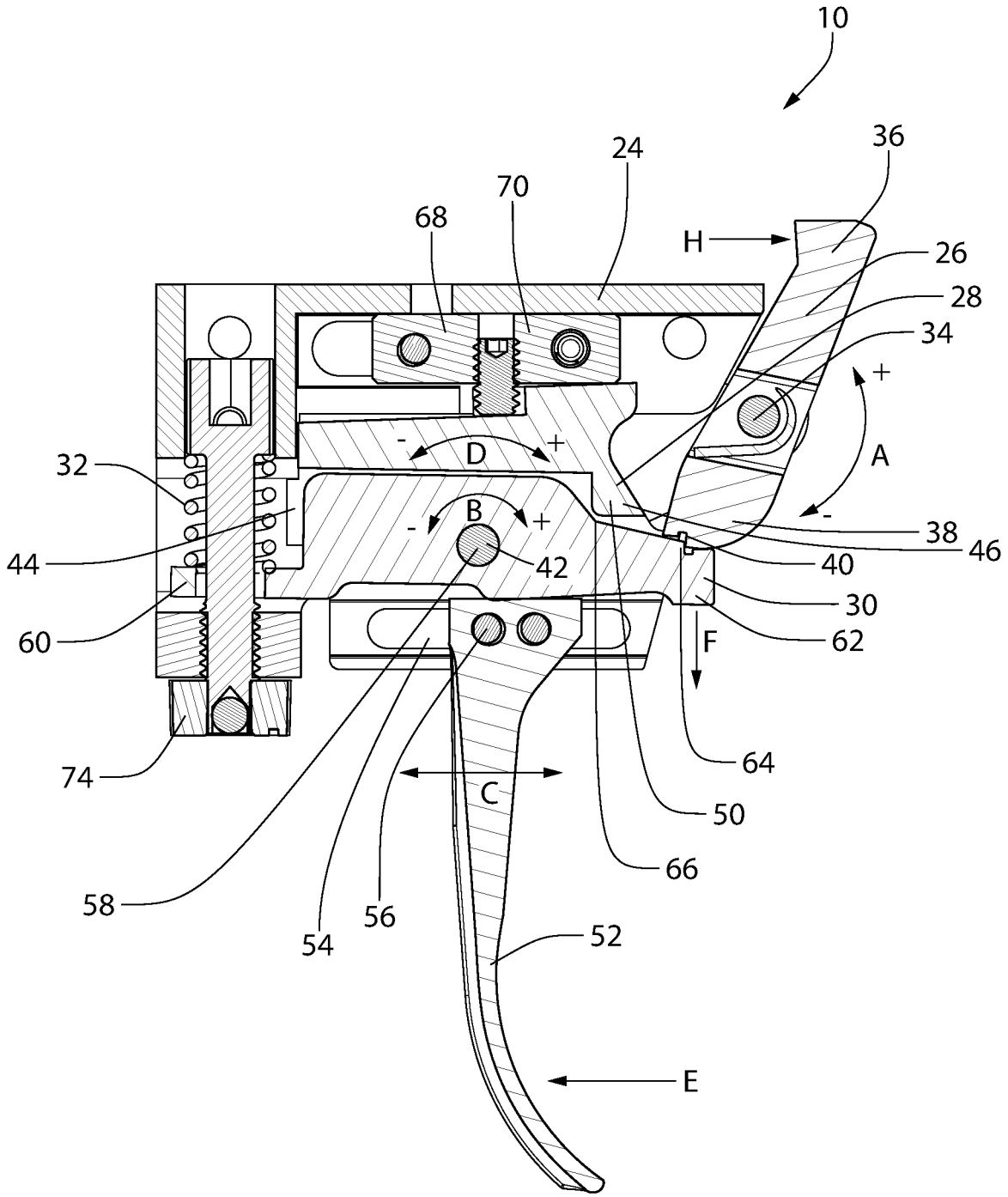
FIG. 7 is a cross-sectional view of the drop safety trigger assembly for a bolt action rifle of FIG. 1, taken substantially along lines FIG. 7—FIG. 7 of FIG. 6, shown in a ready to fire configuration, with a manual safety in an off position.

FIGS. 7-11 depict the configuration of the various elements of the drop safety trigger assembly 10 during different conditions. First, FIG. 7 shows the drop safety trigger assembly 10 in a ready to fire configuration, with a manual safety 68 in an off position. The notch 40 of the sear 26 is fully engaged with the sear release projection 64 of the sear release 30. The sear stop 28 is positioned at its direction D− limit.

Figure 8:
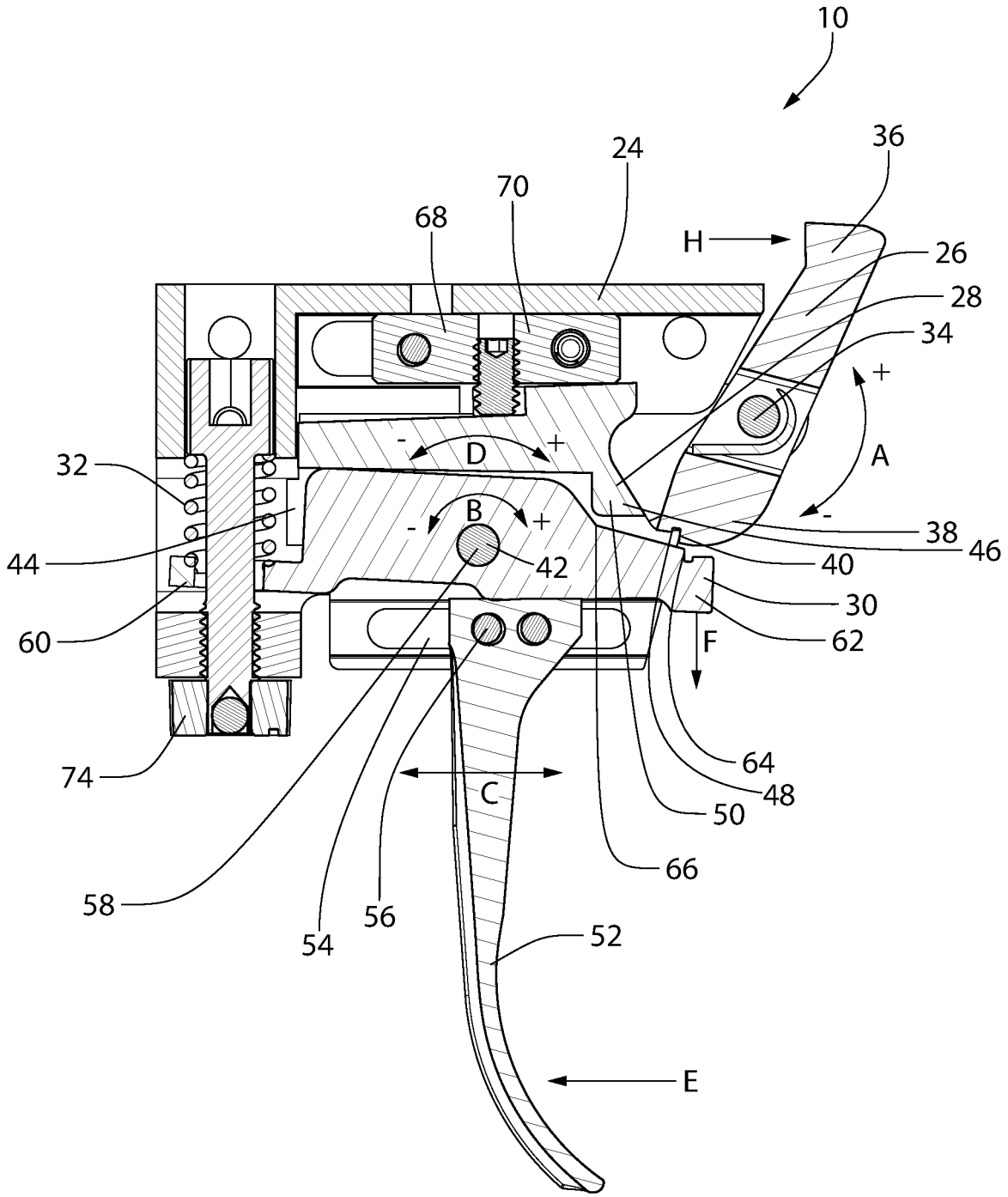
FIG. 8 is a cross-sectional view of the drop safety trigger assembly for a bolt action rifle of FIG. 1, taken substantially along lines FIG. 7—FIG. 7 of FIG. 6, shown in "jarred off" condition.

FIG. 8 shows the drop safety trigger assembly 10 in a "jarred off" condition, wherein the drop safety trigger assembly 10 prevented the rifle 12 from being fired. The notch 40 of the sear 26 is disengaged from the sear release projection 64 of the sear release 30. Notch 40 of the sear 36 engages the sear stop projection 48 of the sear stop 28 to prevent the sear 36 from fully rotating in direction A− (due to the force of the firing pin spring on the first end of the sear 36) to release the firing pin 20 and cause the firearm to fire.

Figure 9:
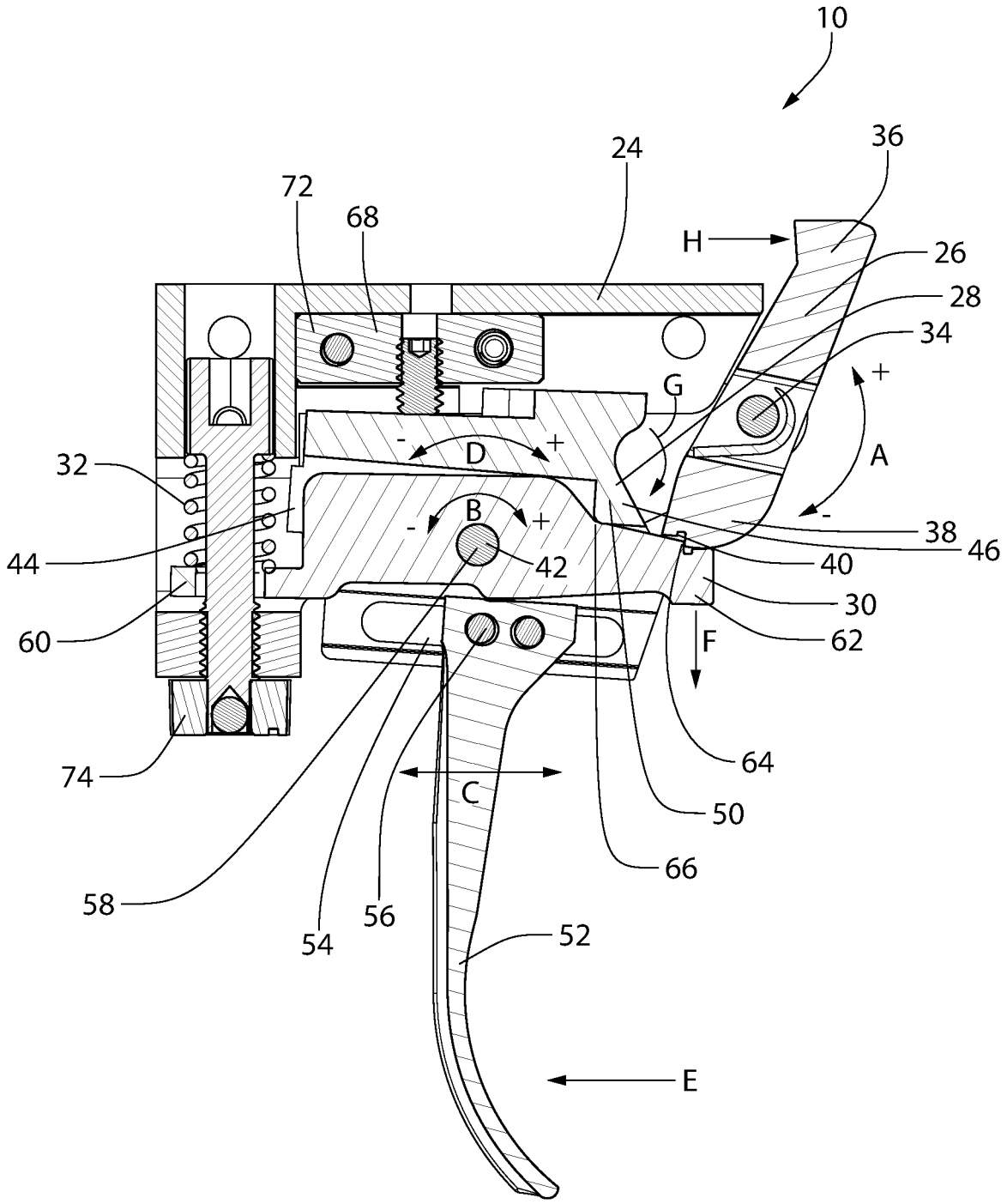
FIG. 9 is a cross-sectional view of the drop safety trigger assembly for a bolt action rifle of FIG. 1, taken substantially along lines FIG. 7—FIG. 7 of FIG. 6, shown in with its trigger shoe pulled, but with the manual safety in an on position.

FIG. 9 shows the drop safety trigger assembly 10 with its trigger shoe 52 pulled, but with the manual safety 68 in an on position 72. The manual safety 68 prevents the sear stop 28 from rotating in direction B+ thereby preventing the firearm from firing. The sear 26 is held in position by the sear notch 40 captured by the sear release projection 64. The firearm is prevented from firing.

Figure 10:
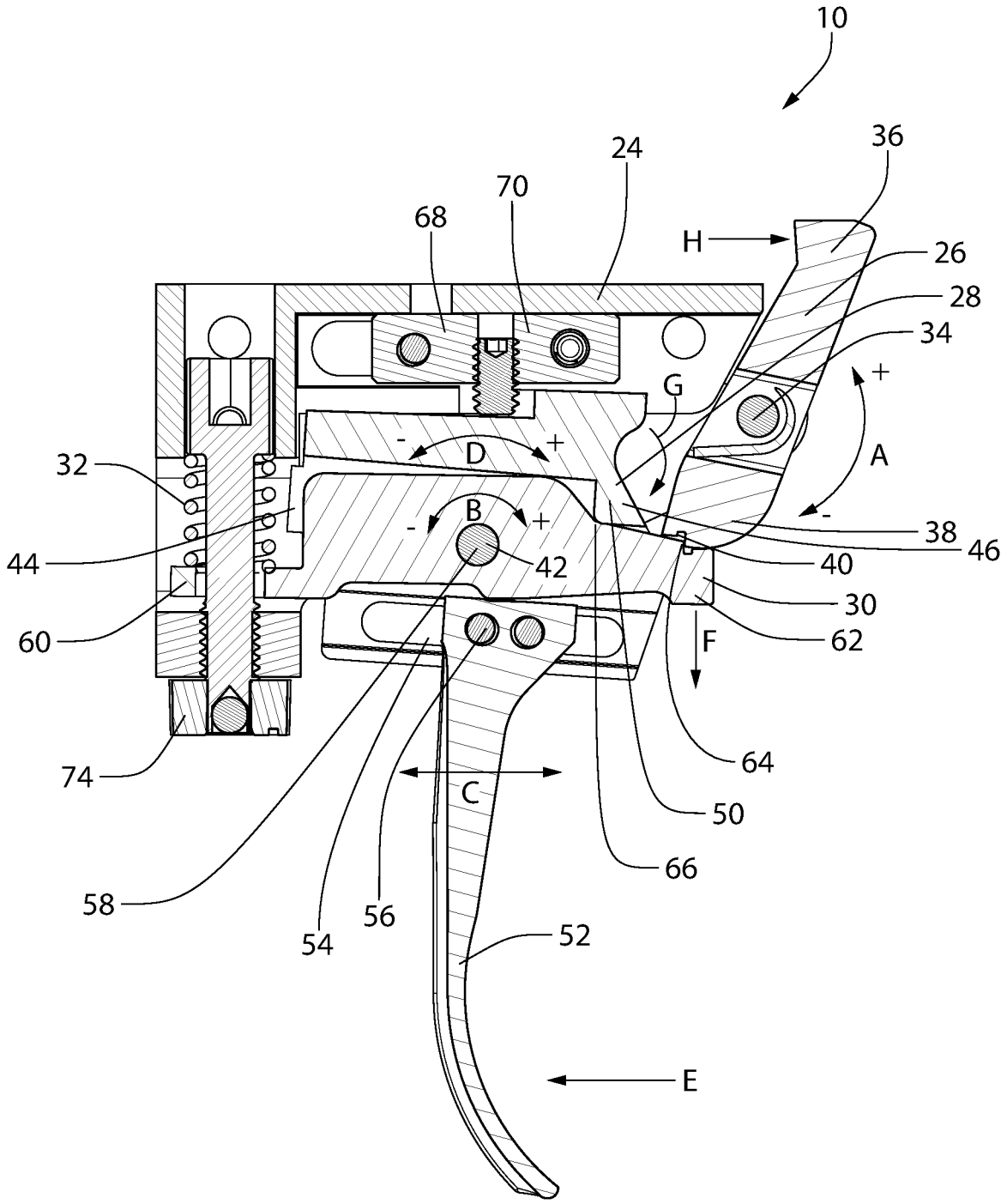
FIG. 10 is a cross-sectional view of the drop safety trigger assembly for a bolt action rifle of FIG. 1, taken substantially along lines FIG. 7—FIG. 7 of FIG. 6, shown with its trigger beginning to be pulled with the manual safety in its off position.

FIG. 10 shows the drop safety trigger assembly 10 shown with its trigger beginning to be pulled with the manual safety in its off position 70. The force on the trigger in direction E causes the sear stop 28 to rotate in direction B+ causing the sear stop protuberance 50 of the sear stop 28 to press against the upper surface 66 of the sear release 30 to cause the sear release to rotate in direction D+ to release the sear 26, allowing it to fully rotate in direction A− causing the firearm to fire.

Figure 11:
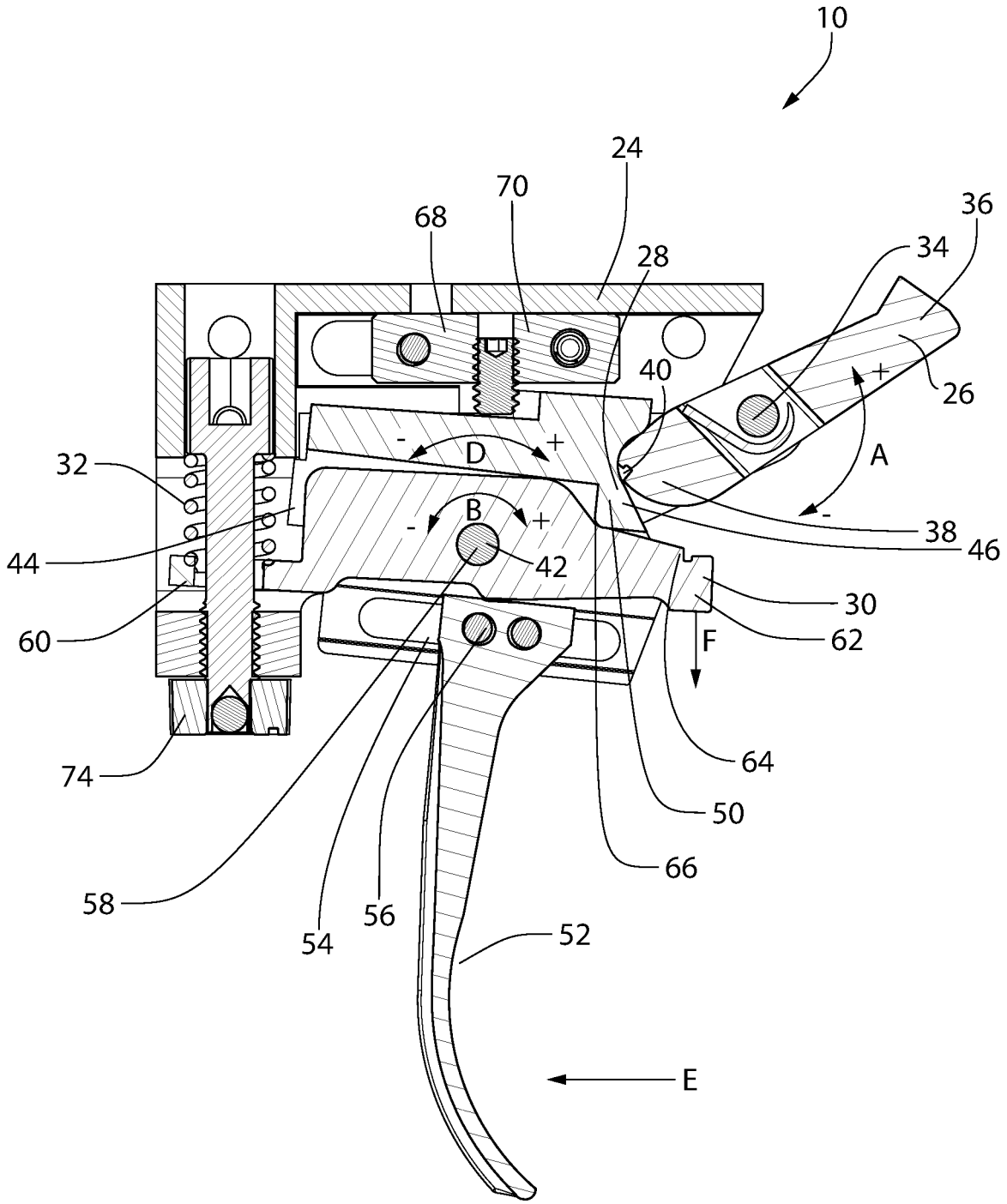
FIG. 11 is a cross-sectional view of the drop safety trigger assembly for a bolt action rifle of FIG. 1, taken substantially along lines FIG. 7—FIG. 7 of FIG. 6, shown subsequent to its trigger having been pulled.

FIG. 11 shows the drop safety trigger assembly 10 for a bolt action rifle 12 of shown subsequent to its trigger shoe 52 having been pulled (in direction E). When a force is applied in direction E by a user to the trigger shoe 52, the sear stop 28 rotates in direction B+ about its pivot point 42 against the force of the trigger spring 32 to cause the sear stop protuberance 50 to apply a force (direction G) to the upper surface 66 of the sear release 30 to release the sear projection 64 of the sear release 30 from the notch 40 of the sear 26 to cause the sear 26 to rotate in direction A− due to the force (direction H) of the firing pin spring 22 on the second end 38 of the sear 26 to cause the first end 36 of the sear 26 to disengage from the firing pin 20 to cause the firearm to fire.

The safety bar 68 that is manually slidably may be disposed in the fire control housing 24 between a first position 70 and a second position 72. The safety bar 68 prevents a discharge of the rifle 12 from occurring when in the first position 70 by engaging the sear stop 28. The safety bar 68 allows for a discharge of the rifle 12 to occur when in the second position 72, wherein the safety bar disengages from the sear stop.

A manually operated trigger force adjuster 74 may be provided to change the force of the trigger spring 32 on the first end 60 of the sear release 30. Here, the trigger adjuster may be, for example, a threaded fastener. The trigger shoe 52 may be slidably adjustable within the slot 54 in the sear stop 28.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A drop safety trigger assembly for a firearm, the firearm comprising a receiver and a barrel, a firing pin and firing pin spring, the drop safety trigger assembly disposed in the receiver and comprising:

(a) a fire control housing disposed in the receiver;

(b) a sear rotatably secured to the fire control housing, the sear comprising:

(i) a first end to engage and disengage the firing pin;

(ii) a central pivot point; and (iii) a second end having a notch;

(c) a sear stop rotatably secured to the fire control housing, the sear stop comprising:

(i) a first end;

(ii) a central pivot point rotatably secured to the fire control housing;

(iii) a second end having a sear stop projection for receipt in the notch of the sear;

(iv) a sear stop protuberance disposed between the sear stop pivot point and the second end; and (v) a trigger shoe; and (d) a sear release rotatably secured to the fire control housing, the sear release comprising:
(i) a first end;
(ii) a second end having a sear release projection to receive the notch of the sear;
(iii) a central pivot point coaxial with the central pivot point of the sear stop, the pivot point disposed between the first end and the second end of the sear release; and
(iv) an upper surface to engage the sear stop protuberance;
(e) a trigger spring to bias the first end of the sear release downwardly;
wherein when a force by a user is applied to the trigger shoe, the sear stop rotates at its pivot point against the force of the trigger spring to cause the sear stop protuberance to apply a force to the upper surface of the sear release to release the sear projection of the sear release from the notch of the sear to cause the sear to rotate due to the force of the firing pin spring on the second end of the sear to cause the first end of the sear to disengage from the firing pin to initiate a discharge of the rifle;
wherein when no force by a user is applied to the trigger shoe to rotate the sear stop, but when the sear projection of the sear release disengages from the notch of the sear, the sear projection of the sear stop engages the notch of the sear to prevent a discharge of the rifle.

2. The drop safety trigger assembly of claim 1, including a safety bar manually slidably disposed in the fire control housing between a first position and a second position, wherein safety bar prevents a discharge of the rifle from occurring when in the first position by engaging the sear stop, and wherein the safety bar allows for discharge of the rifle to occur when in the second position, wherein the safety bar disengages from the sear stop.

3. The drop safety trigger assembly of claim 1, wherein a manually operated trigger adjuster is provided to change the force of the trigger spring on the first end of the sear release.

4. The drop safety trigger assembly of claim 3, wherein the trigger adjuster is a threaded fastener.

5. The drop safety trigger assembly of claim 1, wherein the trigger shoe is slidably adjustable within a slot in the sear stop.

6. The drop safety trigger assembly of claim 1, wherein the firearm is a bolt action rifle having a bolt slidably disposed in the receiver, the bolt having the firing pin and firing pin disposed therein.

7. A drop safety trigger assembly for a bolt action rifle, the rifle comprising a receiver, a barrel and a bolt slidably disposed in the receiver and having a firing pin and firing pin spring, the drop safety trigger assembly disposed in the receiver and comprising:
(a) a fire control housing disposed in the receiver;
(b) a sear rotatably secured to the fire control housing, the sear comprising:
(i) a first end to engage and disengage the firing pin;
(ii) a central pivot point; and
(iii) a second end having a notch;
(c) a sear stop rotatably secured to the fire control housing, the sear stop comprising:
(i) a first end;
(ii) a central pivot point rotatably secured to the fire control housing;
(iii) a second end having a sear stop projection for receipt in the notch of the sear;
(iv) a sear stop protuberance disposed between the sear stop pivot point and the second end; and
(v) a trigger shoe; and
(d) a sear release rotatably secured to the fire control housing, the sear release comprising:
(i) a first end;
(ii) a second end having a sear release projection to receive the notch of the sear;
(iii) a central pivot point coaxial with the central pivot point of the sear stop, the pivot point disposed between the first end and the second end of the sear release; and
(iv) an upper surface to engage the sear stop protuberance;
(e) a trigger spring to bias the first end of the sear release downwardly;
wherein when a force by a user is applied to the trigger shoe, the sear stop rotates at its pivot point against the force of the trigger spring to cause the sear stop protuberance to apply a force to the upper surface of the sear release to release the sear projection of the sear release from the notch of the sear to cause the sear to rotate due to the force of the firing pin spring on the second end of the sear to cause the first end of the sear to disengage from the firing pin to initiate a discharge of the rifle;
wherein when no force by a user is applied to the trigger shoe to rotate the sear stop, but when the sear projection of the sear release disengages from the notch of the sear, the sear projection of the sear stop engages the notch of the sear to prevent a discharge of the rifle.

8. The drop safety trigger assembly of claim 7, including a safety bar manually slidably disposed in the fire control housing between a first position and a second position, wherein safety bar prevents a discharge of the rifle from occurring when in the first position by engaging the sear stop, and wherein the safety bar allows for discharge of the rifle to occur when in the second position, wherein the safety bar disengages from the sear stop.

9. The drop safety trigger assembly of claim 7, wherein a manually operated trigger adjuster is provided to change the force of the trigger spring on the first end of the sear release.

10. The drop safety trigger assembly of claim 9, wherein the trigger adjuster is a threaded fastener.

11. The drop safety trigger assembly of claim 7, wherein the trigger shoe is slidably adjustable within a slot in the sear stop.

* * * * *